US007942131B2

(12) United States Patent
Hoffmann et al.

(10) Patent No.: US 7,942,131 B2
(45) Date of Patent: May 17, 2011

(54) INJECTION SYSTEM HAVING A DEVICE FOR METERING FUEL INTO AN EXHAUST SYSTEM OF AN INTERNAL COMBUSTION ENGINE AND A METHOD FOR THIS PURPOSE

(75) Inventors: Michael Hoffmann, Weinstadt (DE); Helmut Pichler, Stuttgart (DE)

(73) Assignee: Daimler AG, Stuttgart (DE)

( * ) Notice: Subject to any disclaimer, the term of this patent is extended or adjusted under 35 U.S.C. 154(b) by 384 days.

(21) Appl. No.: 12/229,898

(22) Filed: Aug. 27, 2008

(65) Prior Publication Data

US 2009/0050109 A1 Feb. 26, 2009

Related U.S. Application Data

(63) Continuation-in-part of application No. PCT/EP2007/001064, filed on Feb. 8, 2007.

(30) Foreign Application Priority Data

Feb. 28, 2006 (DE) ..... 10 2006 009 099

(51) Int. Cl.
*F02M 37/04* (2006.01)
*F02M 33/08* (2006.01)

(52) U.S. Cl. ..... 123/447; 123/511; 123/514; 60/303

(58) Field of Classification Search ..... 123/447, 123/457, 461, 510, 511, 514; 60/303
See application file for complete search history.

(56) References Cited

U.S. PATENT DOCUMENTS

| | | | | |
|---|---|---|---|---|
| 5,189,876 | A * | 3/1993 | Hirota et al. | 60/286 |
| 5,522,218 | A * | 6/1996 | Lane et al. | 60/274 |
| 5,665,318 | A * | 9/1997 | Rembold et al. | 422/177 |
| 5,806,310 | A * | 9/1998 | Daidou et al. | 60/286 |
| 5,976,475 | A * | 11/1999 | Peter-Hoblyn et al. | 423/212 |
| 6,063,350 | A * | 5/2000 | Tarabulski et al. | 423/239.1 |
| 6,182,444 | B1 * | 2/2001 | Fulton et al. | 60/277 |

FOREIGN PATENT DOCUMENTS

| | | |
|---|---|---|
| DE | 196 25 447 | 1/1998 |
| DE | 102 51 686 | 10/2003 |
| JP | 08 284647 | 10/1996 |
| JP | 10 061432 | 3/1998 |
| JP | 2002038939 | 2/2002 |
| JP | 2002 213231 | 7/2002 |
| JP | 2002 256850 | 9/2002 |
| WO | WO 02/43840 | 6/2002 |

* cited by examiner

*Primary Examiner* — Hai H Huynh
(74) *Attorney, Agent, or Firm* — Klaus J. Bach

(57) ABSTRACT

In an injection system having a device for metering fuel into an exhaust system of a Diesel engine, and a method for controlling the injection of fuel into the exhaust system, wherein the injection system has a high-pressure pump which feeds fuel to an accumulator under high pressure and injectors which inject fuel from the accumulator into the combustion chambers of the internal combustion engine, a fuel spray nozzle arranged in the exhaust system is in communication with the injection system via a fuel metering unit including a control valve and a metering valve and a pressure regulating valve is arranged between the control valve and the metering valve for controlling the pressure of the fuel being metered by the metering valve for injection into the exhaust system via the spray nozzle.

11 Claims, 2 Drawing Sheets

INJECTION SYSTEM HAVING A DEVICE FOR METERING FUEL INTO AN EXHAUST SYSTEM OF AN INTERNAL COMBUSTION ENGINE AND A METHOD FOR THIS PURPOSE

This is a Continuation-in-Part Application of pending international patent application PCT/EP2007/001064 filed Feb. 8, 2007 and claiming the priority of German patent application 10 2006 099.3 filed Feb. 28, 2006.

BACKGROUND OF THE INVENTION

The invention relates to a fuel injection system including a device for metering fuel into an exhaust system of an internal combustion engine, particularly a common rail Diesel engine, with a high pressure fuel line extending from the common rail to the exhaust system for injecting fuel into the exhaust system and to a method for metering the fuel into the exhaust system.

It is known to collect soot particles contained in the exhaust gas of diesel internal combustion engines in particle filters. To regenerate the particle filter, the soot which is trapped in the particle filter is oxidized by means of oxygen. The temperature of the particle filter required for oxidation can be attained with the aid of an oxidation catalytic converter which is positioned upstream. For this purpose, a metered quantity of fuel is additionally sprayed into the exhaust gas of the internal combustion engine upstream of the oxidation catalytic converter, in order to thereby generate the required temperature increase by means of a chemical reaction of the fuel in the oxidation catalytic converter.

The laid-open specification DE 102 51 686 A1 discloses a fuel injection system having a device for metering fuel into an exhaust system of an internal combustion engine.

The injection system is designed in the form of an accumulator injection system (common rail). The accumulator injection system has a fuel pump which feeds fuel from a fuel tank into an accumulator and stores said fuel under high pressure. Connected to the accumulator are injectors which spray fuel from the accumulator in each case into one combustion chamber of the internal combustion engine. The injection system has an injection valve via which fuel can be sprayed into the exhaust system. An injection nozzle and an actuator which controls the injection nozzle are combined in the injection valve, with the actuator being activated by a control unit. The fuel pump conducts fuel from the fuel tank to the injection valve. Arranged between the fuel pump and the injection valve is a check valve which, in an emergency, can block the fuel flow to the injection nozzle. Also provided is a fuel pressure sensor which can measure the pressure of the fuel upstream of the injection valve.

The regeneration of the particle filter takes place at low exhaust-gas and oxidation catalytic converter or particle filter temperatures by means of the injectors, which spray additional fuel into the combustion chambers of the internal combustion engine. At high exhaust-gas and oxidation catalytic converter or particle filter temperatures, fuel is sprayed by means of the injection valve into the exhaust system of the internal combustion engine. This is intended to ensure that, in all load and speed ranges of the internal combustion engine, the fuel injected for the regeneration of the particle filter can pass into a vaporized state before the fuel impinges on the oxidation catalytic converter or as the fuel impinges on the oxidation catalytic converter. A disadvantage here is that the spraying of fuel by means of the injectors adversely affects the thermodynamic efficiency of the internal combustion engine and the device for metering fuel into the exhaust system of the internal combustion engine is not suitable for ensuring effective regeneration of the particle filter at low exhaust-gas and oxidation catalytic converter or particle filter temperatures.

It is an object of the present invention to provide an injection system having a device for metering fuel injected into the exhaust gas for an efficient regeneration of the particle filter in all load and speed ranges of the internal combustion engine, so that additional injection of fuel into the combustion chambers is not necessary.

SUMMARY OF THE INVENTION

In an injection system having a device for metering fuel into an exhaust system of a Diesel engine, and a method for controlling the injection of fuel into the exhaust system, wherein the injection system has a high-pressure pump which feeds fuel to an accumulator under high pressure and injectors which inject fuel from the accumulator into the combustion chambers of the internal combustion engine, a fuel spray nozzle arranged in the exhaust system is in communication with the injection system via a fuel metering unit including a control valve and a metering valve and a pressure regulating valve is arranged between the control valve and the metering valve for controlling the pressure of the fuel being metered by the metering valve for injection into the exhaust system via the spray nozzle.

The control valve controls the supply of fuel from the injection system to the injection nozzle, and the metering valve meters the released fuel to the injection nozzle. The injection nozzle sprays the metered fuel into the exhaust system in order to thereby regenerate a particle filter in the exhaust system downstream of the injection nozzle. The pressure regulating valve arranged between the check valve and the metering valve keeps the pressure of the fuel between the control valve and the metering valve at a certain value, by virtue of some of the fuel being discharged between the check valve and the metering valve via the outflow line. The discharged fuel is returned to the injection system. The pressure of the fuel upstream of the metering valve can advantageously be controlled within tight limits, such that it is possible to meter even the smallest quantities of fuel from the injection nozzle with a high level of accuracy, so that even at low exhaust-gas temperatures all the fuel can vaporize before it reaches the oxidation catalytic converter.

In one refinement of the device according to the invention, a throttle is positioned upstream of the control valve. The fuel from the injection system flows via the throttle to the control valve and, when the control valve is open, onward to the metering valve and to the pressure regulating valve. Pressure fluctuations in the fuel are advantageously smoothed out of the injection system by the throttle, as a result of which the accuracy in the control of the pressure of the fuel upstream of the metering valve can be improved further.

In a further refinement of the device according to the invention, the throttle, the control valve, the metering valve and the pressure regulating valve are combined in one dosing unit. The dosing unit is connected to the injection system by way of the inflow line and by way of the outflow line. The fuel flows via the inflow line into the metering unit. In the metering unit, the fuel flows through the throttle to the control valve, downstream of the control valve to the metering valve and to the pressure regulating valve, downstream of the metering valve to the spray nozzle, and downstream of the pressure regulating valve into the outflow line. The throttle, the control valve, the metering valve and the pressure regulating valve are combined in a space-saving manner in a single component.

In a further embodiment of the device according to the invention, the control valve, the metering valve and the pressure regulating valve are connected to one another by means of a damping volume. By means of the damping volume, pressure waves in the fuel are advantageously eliminated from the injection system, as a result of which the accuracy in the control of the pressure of the fuel upstream of the metering valve can be improved.

In a further refinement of the device according to the invention, the injection nozzle is connected by means of an injection line to the metering unit. The metering unit is connected by means of the inflow line to the injection system, and the spray nozzle is connected by means of the injection line to the metering unit. It is advantageously possible for the metering unit and injection nozzle to be provided spatially separate from one another on the internal combustion engine or exhaust system, such that it is possible to attach only the spray nozzle and, in sections, the injection line, in the hot region of the exhaust system.

In a further refinement of the device according to the invention, the injection or spray nozzle opens automatically, and sprays fuel into the exhaust system, as a result of the pressure of the fuel in the injection line. The pressure of the fuel set by the metering unit exceeds the opening pressure of the preferably spring-loaded injection nozzle, such that the injection nozzle opens automatically and the released fuel is sprayed into the exhaust system of the internal combustion engine. The pressure of the fuel is advantageously controlled within tight limits by means of the pressure regulating valve, as a result of which the sprayed fuel quantity is dependent substantially only on the opening duration of the metering valve, whereby the sprayed fuel quantity can be controlled in a precise manner.

In a further refinement of the device according to the invention, the metering unit is connected by means of the inflow line to a low-pressure circuit of the injection system. The injection system has a low-pressure circuit and a high-pressure circuit which is supplied with fuel from the low-pressure circuit. The high-pressure circuit provides the injectors with highly pressurized fuel for the injection of fuel into the combustion chambers of the internal combustion engine. A fuel pressure provided by the low-pressure pump is sufficient to mix and vaporize the sprayed fuel by means of the device according to the invention for metering fuel into the exhaust system. Advantageously, no fuel from the high-pressure circuit is required for the regeneration of the particle filter.

In a further refinement of the device according to the invention, the metering unit is connected by means of the outflow line to a return flow line of the injection system. Discharged fuel flows from the low-pressure circuit and from the high-pressure circuit of the injection system into the return flow line. The discharged fuel is advantageously supplied from the metering unit back to the injection system.

In the method according to the invention fuel for one or more sprays through the injection valve nozzle is supplied via the control valve, and the supplied fuel is metered to the injection nozzle by means of the metering valve in one or more spray events. The pressure of the released fuel between the control valve and the metering valve is controlled by means of the pressure regulating valve. The check valve releases the fuel from the injection system for one or more spray events through the injection nozzle. The metering valve meters the fuel supplied by the control valve, such that the automatically-opening injection nozzle sprays fuel in one or more spray events into the exhaust system of the internal combustion engine. The pressure regulating valve controls the pressure of the supplied fuel between the control valve and the metering valve, such that the pressure of the fuel upstream of the metering valve is leveled to a certain value. Fuel is advantageously extracted from the injection system only during the spraying of fuel into the exhaust system.

In one refinement of the method according to the invention, some of the fuel is discharged between the control valve and the metering valve by means of the pressure regulating valve. Precise control of the pressure of the fuel is advantageously obtained by means of the discharge of some of the fuel.

Preferably, the pressure of the fuel between the control valve and the metering valve is adjusted by means of the pressure regulating valve to a pressure which lies below the lowest feed pressure of the low-pressure pump. A uniform pressure level for the spraying of fuel into the exhaust system is advantageously ensured in all load and speed ranges of the internal combustion engine.

Further features and combinations of features will become more readily apparent from the following description with reference to the accompanying drawings which show an exemplary embodiment of the invention in simplified form.

DESCRIPTION OF PARTICULAR EMBODIMENTS

Figure 1:
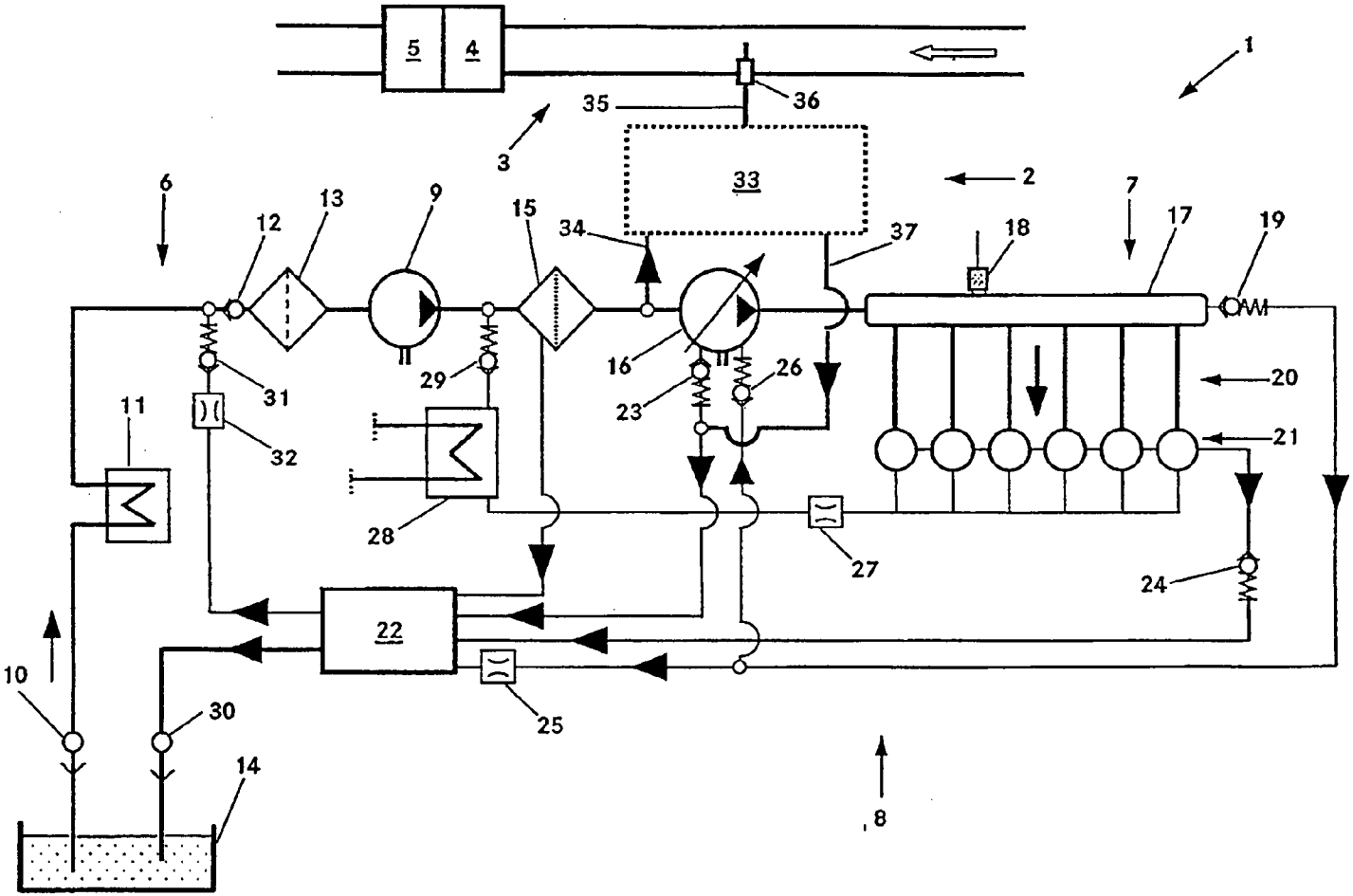
FIG. 1 is a schematically simplified illustration of an exemplary embodiment according to the invention of an injection system having a device for metering fuel into an exhaust system of an internal combustion engine.

As shown in FIG. 1 a fuel injection system 1 for a diesel engine includes a device 2 for metering fuel into an exhaust system 3 of an internal combustion engine.

The fuel injection system 1 for injecting fuel into the cylinders of the internal combustion engine in particular a diesel internal combustion engine, includes an accumulator (common rail). The injection system 1 however also supplies fuel to the device 2 for metering fuel into the exhaust system 3 of the internal combustion engine (not illustrated in any more detail). Provided in the exhaust system 3 is an exhaust-gas purification system having an oxidation catalytic converter 4 and a particle filter 5 which is arranged downstream of the oxidation catalytic converter 4. The device 2 for metering fuel discharges fuel into the exhaust system 3 upstream of the oxidation catalytic converter 4. The fuel is mixed with the exhaust gas and is carried with the exhaust gas to the oxidation catalytic converter 4. In the oxidation catalytic converter 4, the fuel is converted into heat by means of a chemical reaction. The particle filter 5 is regenerated by virtue of the soot trapped in the particle filter 5 being oxidized with the aid of oxygen. The exhaust gas or particle filter temperature required for this purpose is generated in the oxidation catalytic converter 4.

The injection system 1 comprises a low-pressure circuit 6, a high-pressure circuit 7 and a return flow line 8. The low-pressure circuit 6 supplies the high-pressure circuit 7 with fuel. The fuel which is discharged for the purpose of ventilation, pressure regulation and control of the injection system 1 flows into the return flow line 8.

The low-pressure circuit 6 has a low-pressure pump 9 which sucks fuel from a fuel tank 14 via a check valve 10, a cooler 11, a non-return valve 12 and a pre-filter 13. The fuel from the fuel tank 14 flows firstly through the cooler 11 which is assigned a control unit (not illustrated in any more detail) of the internal combustion engine to cool said control unit. The fuel thereafter has coarse impurities removed from it in the pre-filter 13, before the low-pressure pump 9 feeds the sucked fuel into a filter unit 15. In the filter unit 15, the fuel is fine-cleaned and water contained in the fuel is at least partially separated from the fuel. The check valve 10 is provided at a separating point of the low-pressure circuit 6 with respect to the fuel tank 13, and prevents the low-pressure circuit 6 from running dry after a separation of the low-pressure circuit 6 from the fuel tank 14. The non-return valve 10 prevents the low-pressure circuit 6 from running dry after a shutdown of the injection system 1.

From the filter unit 15, the fuel flows on into the high-pressure circuit 7. In the high-pressure circuit 7, a high-pressure pump 16 feeds the fuel from the low-pressure circuit 6 to the accumulator 17 and stores the fuel under high pressure in the accumulator 17. The high-pressure pump 16 is preferably designed as a controllable in-line piston pump. A pressure sensor 18 serves to determine the pressure of the fuel in the accumulator 17. The pressure sensor 18 is connected to the control unit. The maximum pressure of the fuel in the accumulator 17 is set by means of a pressure valve 19. In the event of a defined pressure of the fuel in the accumulator 17 being exceeded, the pressure valve 19 opens, and excess fuel from the accumulator 17 flows into the return flow line 8.

The accumulator 17 is connected by means of injection lines 20 to injectors 21. The injectors 21 are assigned to in each case one combustion chamber of the internal combustion engine and inject the fuel from the accumulator 17 directly into the combustion chambers. The injectors 21 are controlled by the control unit. The injectors 21 each include a hydraulic pressure booster, as is known per se, which makes further increases the pressure of the fuel as it is ejected from the injectors 21 in relation to the pressure of the fuel in the high-pressure circuit 7, in particular in the accumulator 17 and in the injection lines 20.

Arranged in the return flow line 8 is a fuel collecting volume 22 in which the discharged fuel from the low-pressure circuit 6 and the high-pressure circuit 7 flow together. Connected to the fuel collecting volume 22 is the filter unit 15, out of which at least a part of the fuel fed by the low-pressure pump 9 into the filter unit 15 flows in order to ventilate the filter unit 15. Furthermore, the high-pressure pump 16 is connected to the fuel collecting volume 22 by means of a pressure valve 23 which is integrated into the high-pressure pump 16. The pressure valve 23 discharges fuel in the event of a certain pressure of the fuel in the high-pressure pump 16 being attained. The injectors 21 are connected to the fuel collecting space 22 via of a non-return valve 24. The fuel discharged to control the injectors 21 flows via the non-return valve 24 into the fuel collecting volume 22. The fuel discharged via the pressure valve 19 flows from the accumulator 17 via a throttle 25 into the fuel collecting volume 22. If the pressure valve 19 is in an erroneous open position, the throttle 25 serves to build up a dynamic pressure, such that at least a part of the fuel which is erroneously discharged can flow from the accumulator 17, in the flow direction upstream of the throttle 25, via a non-return valve 26 back into the high-pressure pump 16, thereby ensuring the lubrication of the high-pressure pump 16.

The fuel quantity which is used in, and discharged from, the injectors 21 to provide for the hydraulic pressure boost flows back into the low-pressure circuit 6 between the low-pressure pump 9 and the filter unit 15 via a throttle 27, a fuel cooler 28 and a non-return valve 29. In the fuel cooler 28, the fuel discharged out of the injectors 21 is cooled preferably by means of a coolant circuit (not shown) of the internal combustion engine.

The fuel from the fuel collecting volume 22 flows via a check valve 30 back into the fuel tank 14. The check valve 30 is provided at a separating point of the return flow line 8 with respect to the fuel tank 14 and prevents the low-pressure circuit 6 from running dry if the return flow line 8 is separated from the fuel tank 14. The low-pressure pump 9 sucks fuel from the collecting space 22 via a non-return valve 31 and a throttle 32.

The device for metering fuel 2 into the exhaust system 3 of the internal combustion engine is supplied with fuel by the injection system 1. Between the filter unit 15 and the high-pressure pump 16, a metering unit 33 is connected by means of an inflow line 34 to the low-pressure circuit 6. From the metering unit 33, the fuel flows via an injection line 35 to the injection nozzle 36. The injection nozzle 36 is assigned to the exhaust system 3 and sprays fuel into the exhaust system 3. Fuel discharged from the metering unit 33 flows, together with the fuel discharged from the high-pressure pump 16, via an outflow line 37 into the fuel collecting space 22 of the return flow line 8.

Figure 2:
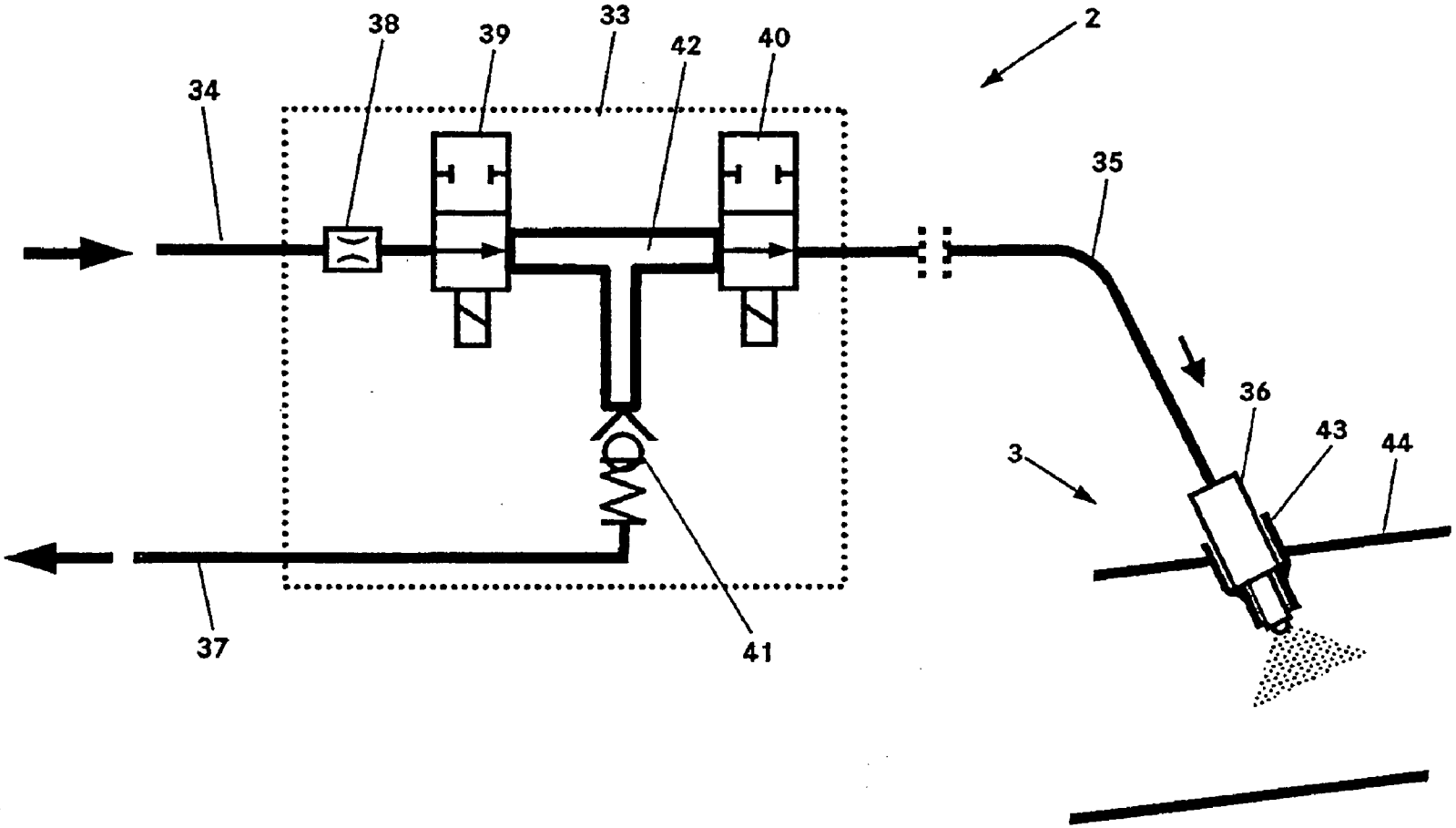
FIG. 2 is a schematically simplified illustration of the device for metering the fuel.

FIG. 2 shows a schematically simplified illustration of the device 2 for metering fuel to the exhaust system. A throttle 38, a control valve 39, a metering valve 40 and a pressure regulating valve 41 are combined in a space-saving fashion in one component in the metering unit 33. The control valve 39 and the metering valve 40 are preferably designed as solenoid valves and are controlled by a control unit. The pressure regulating valve 41 is designed as a spring-loaded throttle valve with a preferably flat pressure regulating characteristic curve. The control valve 39, the metering valve 40 and the pressure regulating valve 41 are connected to one another by way of a damping volume 42.

The fuel from the low-pressure circuit 6 flows via the inflow line 34 through the throttle 38 to the control valve 39. When the control valve 39 is in the open position, the fuel flows onward via the damping volume 42 to the metering valve 40 and to the pressure regulating valve 41. When the metering valve 40 is in the open position, the fuel flows via the injection line 35 to the injection nozzle 36. The injection nozzle 36 is held in a holding device 43 of an exhaust pipe 44 of the exhaust system 3. The preferably spring-loaded injection nozzle 36 opens automatically and sprays fuel into the exhaust system 3.

The pressure regulating valve 41 controls the pressure of the fuel in the metering unit 33 by discharging some of the fuel out of the damping volume 42. The discharged fuel flows via the outflow line 37 into the return flow line 8. As a result of the discharge of the fuel in the metering unit 33, it is possible to control the pressure of the fuel for the spraying of fuel by means of the injection nozzle 36 within tight limits. It is advantageous that the sprayed fuel quantity can be metered in a precise fashion, thereby enabling an efficient regeneration of the particle filter in all load and speed ranges of the internal combustion engine.

The throttle 38 and the damping volume 42 contribute to a further increase in accuracy of the metering of the fuel for the regeneration of the particle filter 5. By means of the throttle 38, it is possible for pressure fluctuations of the fuel for the metering unit 33 which are generated in the low-pressure circuit 6 during the supply to the high-pressure pump 16 by the low-pressure pump 9 to be smoothed. By means of the damping volume 42 which is adapted to the throttle 38, pressure oscillations in the metering unit 33, which are generated by pressure fluctuations in the fuel, can be damped or eliminated.

The injection of the fuel which is required for the regeneration of the particle filter 5 can take place by means of a single spray event or a plurality of spray events. Here, the metering valve 40 permits one or more spray events through the injection nozzle 36 by virtue of the metering valve 40 metering the fuel to the injection nozzle 36 by opening and closing once or a plurality of times in succession. The control valve 39 releases the fuel required for the regeneration of the particle filter 5 for one or more spray events. The pressure regulating valve 41 controls the fuel in the damping volume 42 between the control valve 39 and the metering valve 40. Fuel for the regeneration of the particle filter 5 is advantageously extracted from the injection system 1, in particular from the low-pressure circuit 6, only in phases.

The pressure of the fuel in the metering unit 33 is determined substantially by the pressure of the fuel in the low-pressure circuit 6. Here, the pressure regulating valve 41 levels the pressure of the fuel in the damping volume 42 to a pressure which lies below the lowest feed pressure of the low-pressure pump 9. It is thereby ensured that a sufficient fuel quantity is available for the regeneration of the particle filter 5 in every load state of the internal combustion engine. Furthermore, the fuel quantity flowing into the metering unit 33 is limited by means of the throttle 38, such that the fuel quantity to be controlled by the pressure regulating valve 41 lies in a tighter range than the smallest and largest fuel quantities provided by the low-pressure pump 9. In this way, the accuracy of the pressure regulation can be further increased.

With the device according to the invention and the method for metering fuel, it is possible for the smallest quantities of fuel to be introduced in a precise fashion into the exhaust system 3 of the internal combustion engine in order to ensure vaporization of the sprayed fuel before it impinges on the oxidation catalytic converter 4 in all load and speed ranges of the internal combustion engine, in particular in transient operation, thereby enabling an effective catalytic conversion of the fuel in the oxidation catalytic converter 4 and a regeneration of the particle filter 4.

Furthermore, fuel for the regeneration of the particle filter 5 is extracted from the low-pressure circuit 6 only in phases, such that the low-pressure circuit 6 is not permanently loaded and no fuel from the high-pressure circuit 7 is required. The device according to the invention for metering fuel 2 therefore plays a secondary role for the dimensioning of the injection system 1, in particular of the low-pressure circuit 6, such that it is possible to save on costs and installation space.

What is claimed is:

1. A fuel injection system including an arrangement (2) for metering fuel into an exhaust system of a diesel internal combustion engine, including a low pressure pump (9) and a high-pressure pump (16) which feeds fuel into an accumulator where said fuel is stored under high pressure, injectors which are connected to the accumulator for injecting fuel from the accumulator in each case into one combustion chamber of the internal combustion engine, a spray nozzle (36) mounted to the exhaust system and connected via an inflow line (34) with a pressurized fuel line of the fuel injection system, the arrangement for metering fuel to the exhaust system comprising a fuel control valve (39) for controlling the supply of fuel, a metering valve (40) for controlling the flow volume to the spray nozzle (36) and a pressure regulating valve (41) connected between the control valve (39) and the metering valve (40), the pressure regulating valve (41) having an outflow line (37) for returning excess fuel to the injection system (1).

2. The injection system as claimed in claim 1, wherein a throttle (38) is positioned in the inflow line (34) upstream of the control valve (39).

3. The injection system as claimed in claim 1, wherein the throttle (38), the control valve (39), the metering valve (40) and the pressure regulating valve (41) are combined in a metering unit (33).

4. The injection system as claimed in claim 3, wherein the control valve (39), the metering valve (40) and the pressure regulating valve (41) are connected to one another via a damping volume (42).

5. The injection system as claimed in claim 3, wherein the spray nozzle (36) is connected to the metering unit (33) via an injection line (35).

6. The injection system as claimed in claim 5, wherein the spray nozzle (36) is a pressure controlled valve which opens automatically for spraying fuel into the exhaust system (3) as a result of the pressure of the fuel in the injection line (35).

7. The injection system as claimed in claim 1, wherein the metering unit (33) is connected by means of the inflow line (34) to a low-pressure circuit (6) of the injection system (1).

8. The injection system as claimed in claim 1, wherein the metering unit (33) is connected by means of the outflow line (37) to a return flow line (8) of the injection system (1).

9. A method for metering fuel into an exhaust system of an internal combustion engine having a fuel injection system including an arrangement (2) for metering fuel into the exhaust system, the fuel injection system including a low pressure pump (9) and a high-pressure pump (16) which feeds fuel into an accumulator where said fuel is stored under high pressure, injectors which are connected to the accumulator for injecting fuel from the accumulator in each case into one combustion chamber of the internal combustion engine, a spray nozzle (36) mounted to the exhaust system and connected via an inflow line (34) with a pressurized fuel line of the fuel injection system, the arrangement for metering fuel to the exhaust system comprising a fuel control valve (39) for controlling the supply of fuel, a metering valve (40) for controlling the flow volume to the spray nozzle (36) and a pressure regulating valve (41) connected between the control valve (39) and the metering valve (40), the pressure regulating valve (41) having an outflow line (37) for returning excess fuel to the injection system (1), said method comprising the steps of:

releasing fuel for one or more sprays through the spray nozzle (36) by means of the control valve (39), metering the released fuel to the injection nozzle (36) by means of the metering valve (40) for one or more sprays, and controlling the pressure of the released fuel between the control valve (39) and the metering valve (39) by means of the pressure regulating valve (41).

10. The method as claimed in claim 9, wherein some of the fuel is discharged between the control valve (39) and the metering valve (40) by means of the pressure regulating valve (41).

11. The method as claimed in claim 9, wherein the pressure of the fuel between the control valve (39) and the metering valve (40) is leveled by means of the pressure regulating valve (41) to a pressure below the lowest feed pressure of the low-pressure pump (9).

* * * * *